United States Patent [19]

Heintz et al.

[11] Patent Number: 5,050,479

[45] Date of Patent: Sep. 24, 1991

[54] LOADING MANIPULATOR FOR A FRONT-LOADING MORTAR

[75] Inventors: Wolfgang Heintz; Herbert Lipp; Erich Zielinski, all of Düsseldorf, Fed. Rep. of Germany

[73] Assignee: Rheinmetall GmbH, Düsseldorf, Fed. Rep. of Germany

[21] Appl. No.: 574,281

[22] Filed: Aug. 29, 1990

[30] Foreign Application Priority Data

Nov. 24, 1989 [DE] Fed. Rep. of Germany ..... 3938900

[51] Int. Cl.[5] ..... F41A 9/13

[52] U.S. Cl. ..... 89/46; 89/37.05; 89/1.3

[58] Field of Search ..... 89/37.05, 1.35, 1.3, 89/45, 46

[56] References Cited

U.S. PATENT DOCUMENTS 4,495,852 1/1985 Winkler et al. ..... 89/46

FOREIGN PATENT DOCUMENTS 176776 4/1986 European Pat. Off. .
728266 11/1942 Fed. Rep. of Germany ..... 89/46
3436369 4/1986 Fed. Rep. of Germany ..... 89/46
196391 6/1938 Switzerland ..... 89/46
2115121 9/1983 United Kingdom ..... 89/1.35
2166852 5/1986 United Kingdom ..... 89/37.05

*Primary Examiner*—Deborah L. Kyle
*Assistant Examiner*—Stephen Johnson
*Attorney, Agent, or Firm*—Spencer & Frank

[57] ABSTRACT

A front-loading mortar mounted on a base, such as the top of an armored vehicle, includes a weapon tube having a muzzle; a trunnion axis about which the weapon tube is pivotal for setting an elevation of the weapon tube; a cardan ring surrounding the weapon tube or cradle tube and being circumferentially displaceable about the weapon tube relative thereto; an additional pivot axis defined in the cardan ring at a location situated in front of the trunnion axis; and a loading manipulator, including a loading tray, for moving a round of ammunition to a loading location in front of the muzzle. The loading manipulator includes a loading rocker articulated to the cardan ring for pivotal motion about the additional pivot axis; an elongate positioner articulated to the cardan ring for pivotal motion about the additional pivot axis; and a bearing affixed to the base and receiving an end of the positioner for longitudinal sliding motion and pivotal motion therein.

10 Claims, 4 Drawing Sheets

LOADING MANIPULATOR FOR A FRONT-LOADING MORTAR

BACKGROUND OF THE INVENTION

This invention relates to a loading manipulator for a front-loading mortar. The manipulator has a loading rocker supported for pivotal motion about an axis which is parallel to and spaced from the axis of the weapon tube trunnion. The loading rocker carries a loading tray for conveying a round of ammunition from an inner space of an armored vehicle (on which the mortar is mounted) to the muzzle of the weapon tube.

A loading manipulator of the above-outlined known type-disclosed, for example, in German Offenlegungsschrift 34 36 369—is, for loading the weapon tube, swingable with the aid of parallel guides mounted on the weapon tube, behind armor protection from a loading tray charging position to a location in front of the weapon tube. The weapon tube may be pivoted vertically about the trunnion axis to set its elevation and horizontally by a rotary turret to effect the transverse aiming motion. It is a disadvantage of this arrangement that in case the carrier vehicle is at a tilt on the terrain, the weapon tube cannot be moved transversely and in elevation relative to a horizontal plane.

For horizontally levelling the weapon tube in case of a tilted vehicle, it is known to install a rotatable weapon platform on board of the vehicle, as disclosed in published European application 07 76 776 87. With such a solution, however, difficulties are encountered in coordinating the feed motion of the loading manipulator in the respective variable transverse and elevational positions of the weapon tube with the fixed location in the vehicle where the loading manipulator is charged.

SUMMARY OF THE INVENTION

It is an object of the invention to provide an improved loading manipulator of the above-outlined type with which rounds of ammunition may be moved from a loading hatch, having a fixed location in the vehicle, to the muzzle of a front-loading mortar supported on a levelled platform known by itself, and the weapon tube may be loaded in any transverse and elevational setting thereof.

This object and others to become apparent as the specification progresses, are accomplished by the invention, according to which, briefly stated, the front-loading mortar mounted on a base, such as the top of an armored vehicle, includes a cradle tube which receives a weapon tube having a muzzle; a trunnion axis about which the cradle tube and the weapon tube are together is pivotal for setting an elevation of the weapon tube; a cardan ring surrounding the cradle tube and being circumferentially displaceable about the weapon tube relative thereto; an additional pivot axis defined in the cardan ring at a location situated in front of the trunnion axis; and a loading manipulator, including a loading tray, for moving a round of ammunition to a loading location in front of the muzzle. The loading manipulator includes a loading rocker articulated to the cardan ring for pivotal motion about the additional pivot axis; an elongate positioner articulated to the cardan ring for pivotal motion about the additional pivot axis; and a bearing affixed to the base and receiving an end of the positioner for longitudinal sliding motion and pivotal motion therein.

By supporting, according to the invention, the loading manipulator in a cardan ring which is rotatable in the circumferential direction about the weapon tube or the weapon tube cradle, as the case may be, and by securing a shiftable and pivotal positioner within a bearing assembly affixed to the vehicle, there is advantageously ensured a rapid feed of ammunition from a loading hatch on board of the vehicle directly into a ready-to-load position in front of the weapon tube. By virtue of the cardan ring the weapon tube may assume any desired transverse or elevational position and determines in conjunction with the positioner, in a form-locking relationship therewith, a variable angle of inclination for the momentary feed plane of the loading rocker from the loading hatch up to the weapon tube muzzle. Although the trunnion is articulated parallel to the horizontally levelled weapon platform, in case of a tilted vehicle and thus in case of a vehicle roof which is at an inclination to the weapon platform, the loading rocker may securely assume at all times the same charging position in the immediate vicinity of the fixed loading hatch, by virtue of the unit formed of the cardan ring and the positioner. The positioner and the loading rocker may be arranged opposite the weapon tube or may be arranged jointly with the weapon tube on the side of the loading hatch.

DESCRIPTION OF THE PREFERRED EMBODIMENTS

Figure 1:
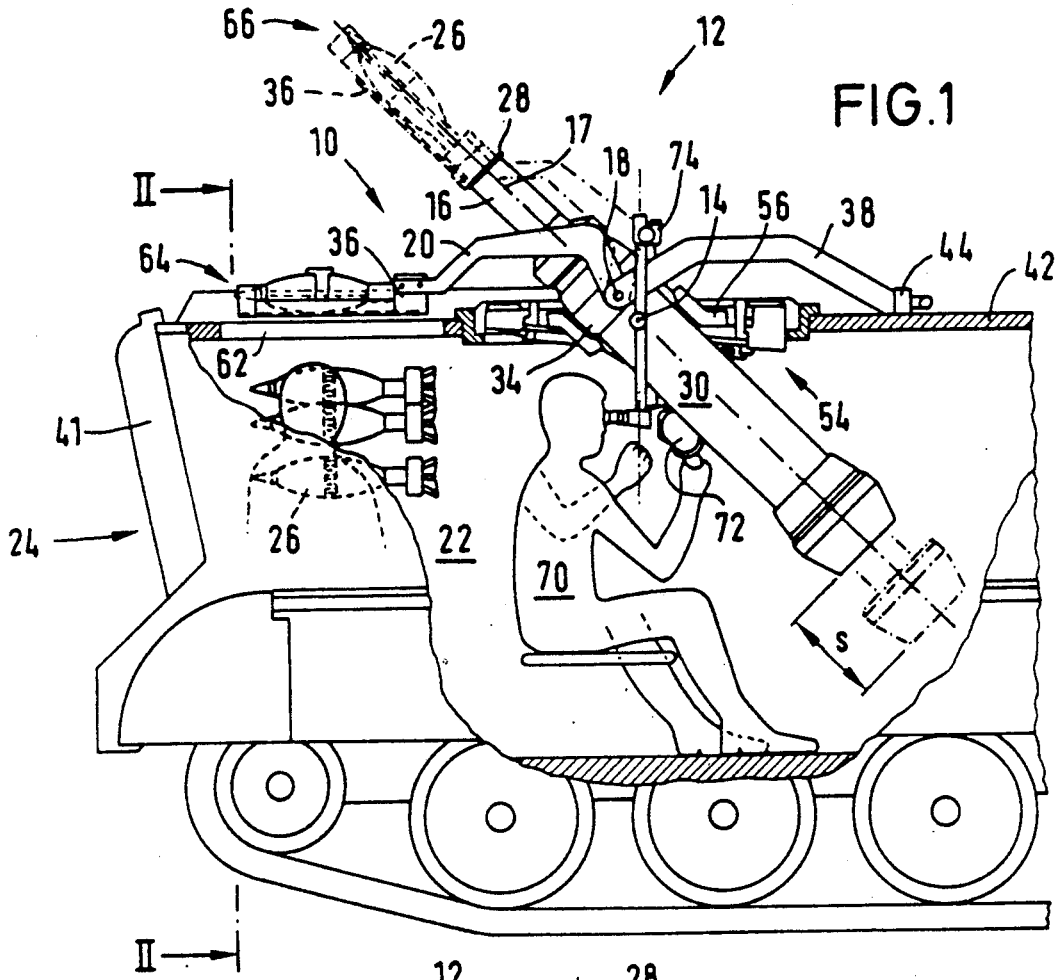
FIG. 1 is a schematic side elevational view of a vehicle with an on-board, front-loading mortar, incorporating a preferred embodiment of the invention.

Turning to FIG. 1, there is illustrated therein a front-loading mortar generally designated at 12 mounted on the roof 42 of a carrier vehicle generally designated at 24. The weapon tube 16 of the mortar 12 is supported in a cradle tube 30 and may execute over a stroke s recoil and recuperating movements after firing. To change the weapon elevation, the cradle tube 30 or, in a non-illustrated manner, the weapon tube 16 may pivot about a trunnion axis 14 in an angular range $\alpha$ (FIG. 3) typical for steep-trajectory weapons. In order to ensure that the weapon tube 16 respectively the cradle tube 30 can be adjusted transversely or in elevation in a problem-free manner in case the vehicle is at a tilt, the axially aligned trunnions are supported in a weapon platform 56 which may be horizontally levelled by means of a device 54 installed in the vehicle 42.

Figure 2:
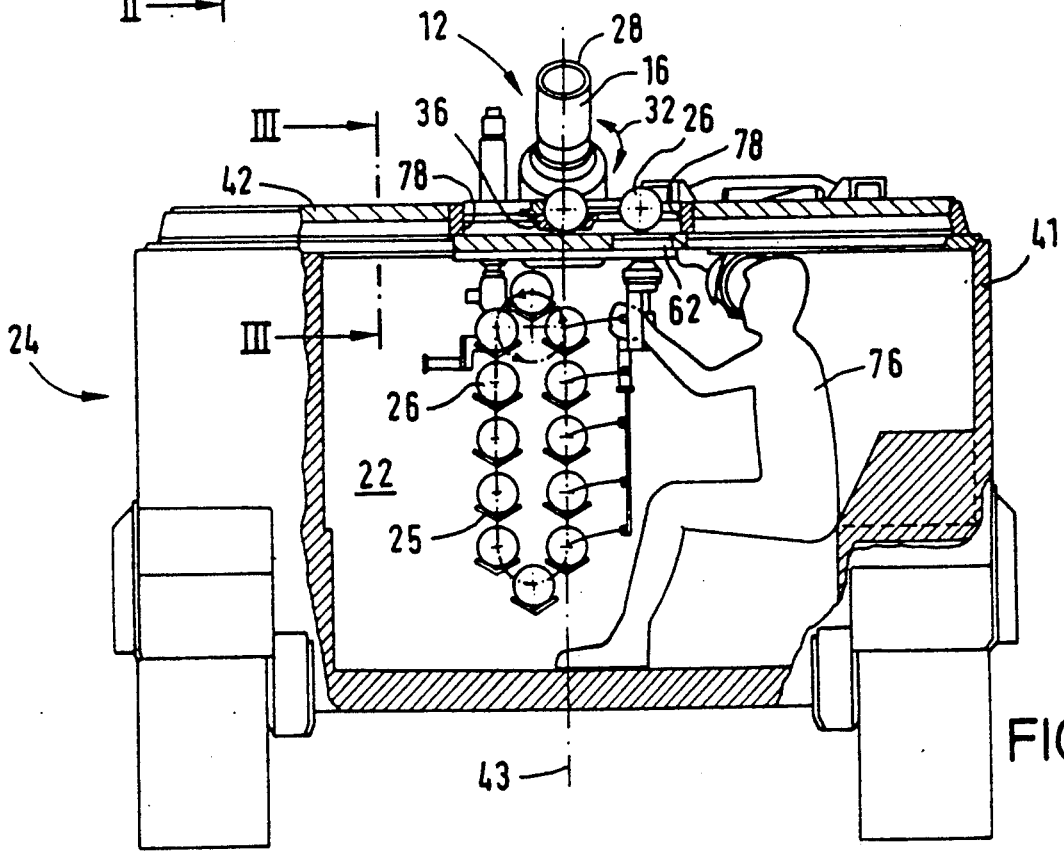
FIG. 2 is a schematic sectional view taken along line II—II of FIG. 1.

A loading manipulator 10 is provided for transporting ammunition under armored protection from an inner space 22 of the vehicle 24, for example, from an endless magazine 25 as shown in FIG. 2, to the front of the muzzle 28 of the weapon tube 16 which has been set into its targeted position for firing. The loading manipulator 10 has a loading rocker 20 which is supported in front of the trunnion axis 14 in a cardan ring 34 which is circumferentially slidable relative to the cradle tube 30 and which carries at its end a loading tray 36 arranged to receive a round of ammunition 26 for transporting the same.

Figure 4:
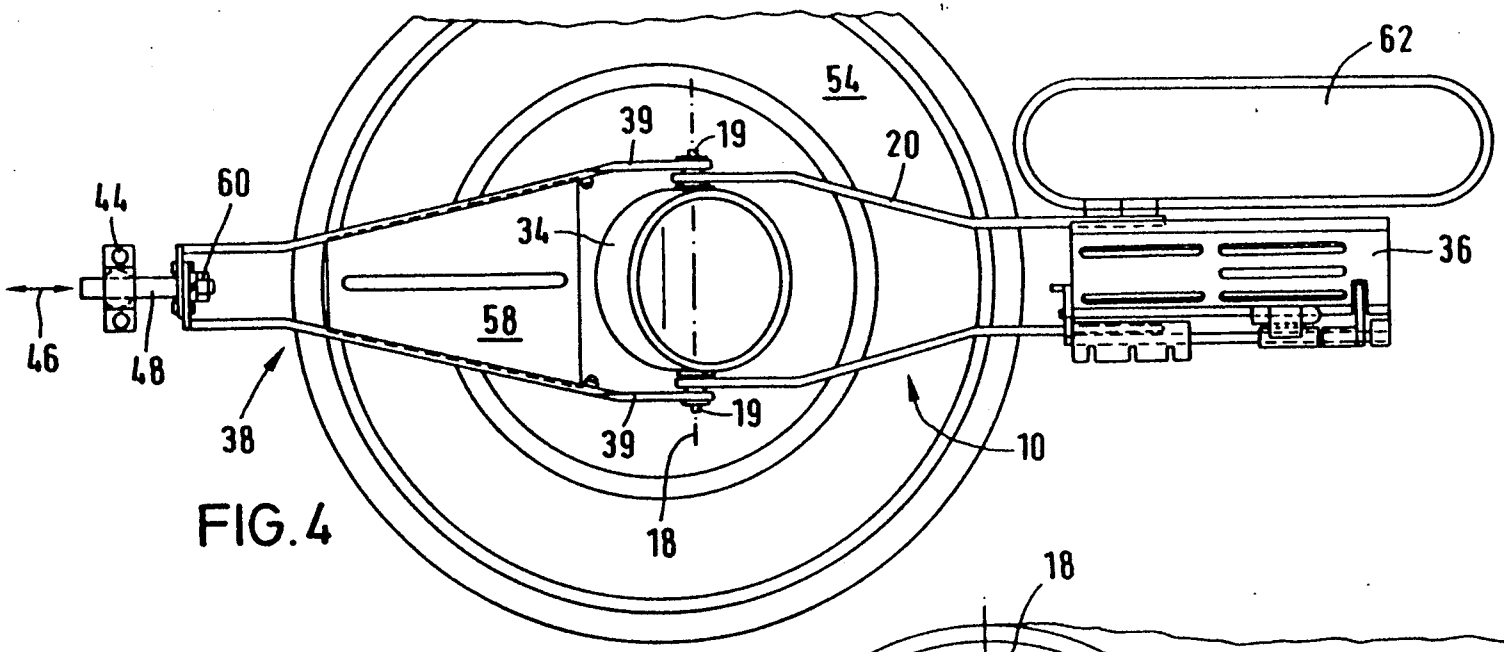
FIG. 4 is a top plan view of the preferred embodiment taken in the direction of the arrow IV in FIG. 3.

To provide for a swinging motion of the loading manipulator 10, externally on the cardan ring 34 there are arranged oppositely looated joints 19 in alignment with a common axis 18 (FIG. 4). The joints 19 are designed such that they also receive a positioner 38 which determines the position of the loading manipulator 10 relative to a loading hatch 62 provided in the vehicle roof 42. For pivotal and axial shifting motions the positioner 38 has a terminal shaft 48 which is secured at its end remote from the cardan ring 34 in a bearing 44 mounted on the vehicle roof 42.

Figure 7:
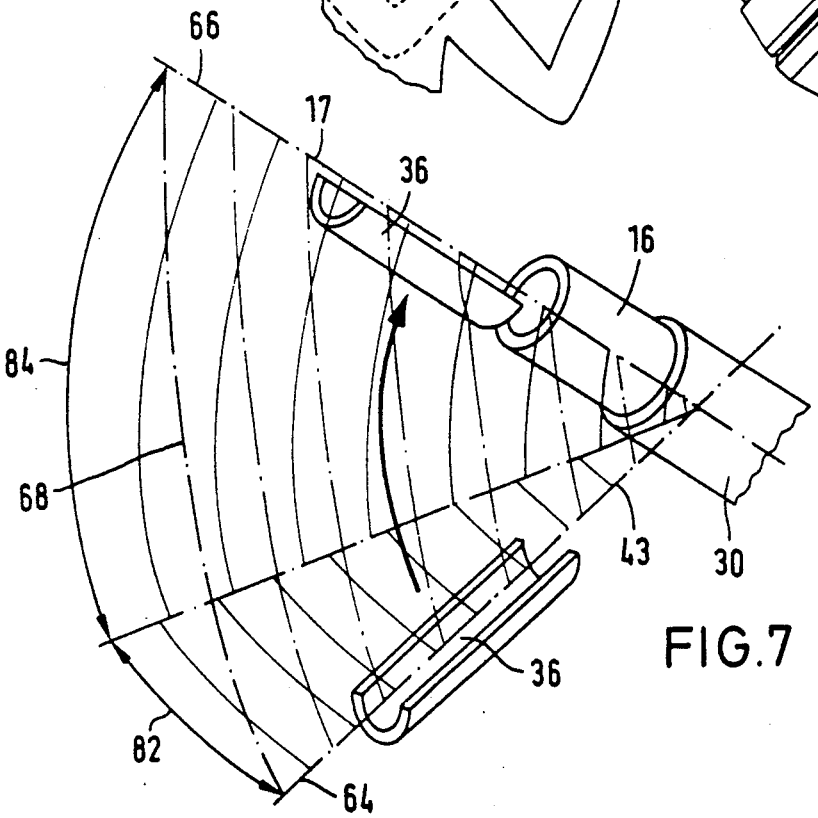
FIG. 7 is a diagram schematically showing the motion path of a loading manipulator with which the invention is used.

Also referring to FIG. 7, by virtue of the rotating motion of the cardan ring 34 about the cradle tube 30 on the one hand and by virtue of the shifting and pivoting motions of the positioner 38 in the bearing 44 on the other hand, the cardan ring 34 may always be maintained in a position in which the loading manipulator 10 can be moved directly in a plane 68 (for example, parallel to the longitudinal vehicle axis 43) between a fixed tray-charging position 64 and a changeable mortar-loading position 66.

The cardan ring 34, by virtue of its arrangement in front of the trunnion axis 14 may freely rotate in the circumferential direction 32 (FIG. 2) about the cradle tube 30 (and thus about the weapon tube 16). Such a motion of the cardan ring 34 occurs, for example, during the aiming motion of the weapon tube 16 in the transverse direction or upon compensation for a known, non-illustrated tilt angle of the vehicle 24 by means of the horizontally levellable weapon platform 56.

The positioner 38 may, by virtue of its longitudinal and pivotal displaceability within the bearing 44, follow the transverse and elevational motions of the weapon tube 16 as well as the compensating motions of the weapon tube 16 relative to a predetermined tilt angle of the vehicle 24.

Figure 6:
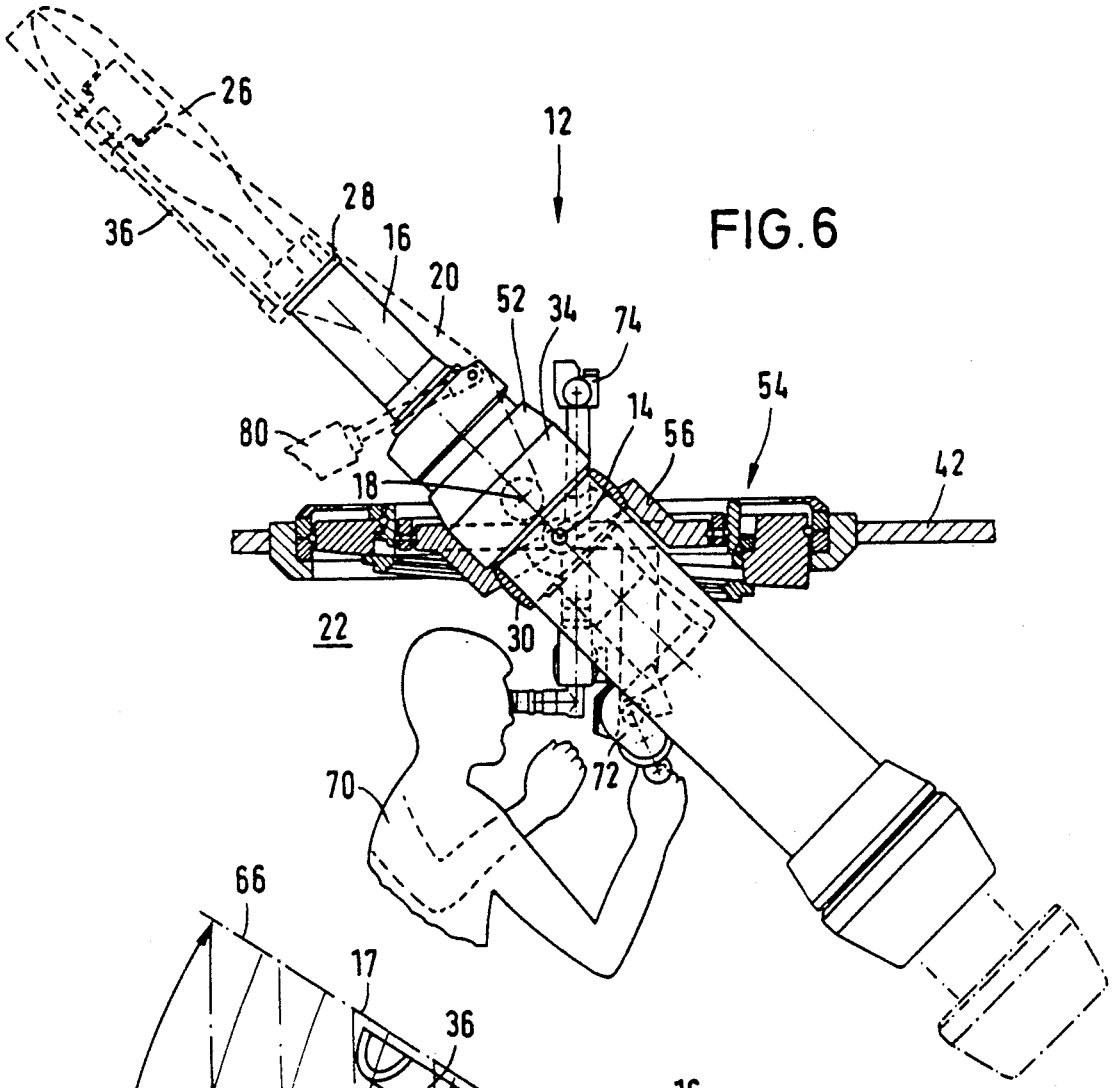
FIG. 6 is a sectional elevational view of the preferred embodiment, illustrating additional details.

As it may be seen in FIG. 1 in conjunction with FIG. 6, the weapon tube 16 may perform aiming motions in the transversal and elevational directions as performed by a gunner 70 with the aid of a known aiming device not described in further detail. For aiming the weapon, the gunner 70 uses a panoramic telescope 74 known by itself. The apparatus 54 illustrated in FIGS. 1 and 6 for horizontally levelling the weapon platform 56 is disclosed in detail in European Patent No. 07 76 776 87.

FIG. 2 illustrates the tray charging process, in the course of which ammunition is placed on the loading tray 36. This operation may be performed, for example, manually by a loader 76 who, in the course of this operation, removes a round of ammunition 26 from an intermittently circulating magazine 25 and places the ammunition through the loading hatch 62 on the loading tray 36 which may be automatically or manually opened and closed.

The charging zone of the loading tray 36 is laterally protected by walls 78. The loading hatch 62 may be closed in a manner not illustrated.

Figure 3:
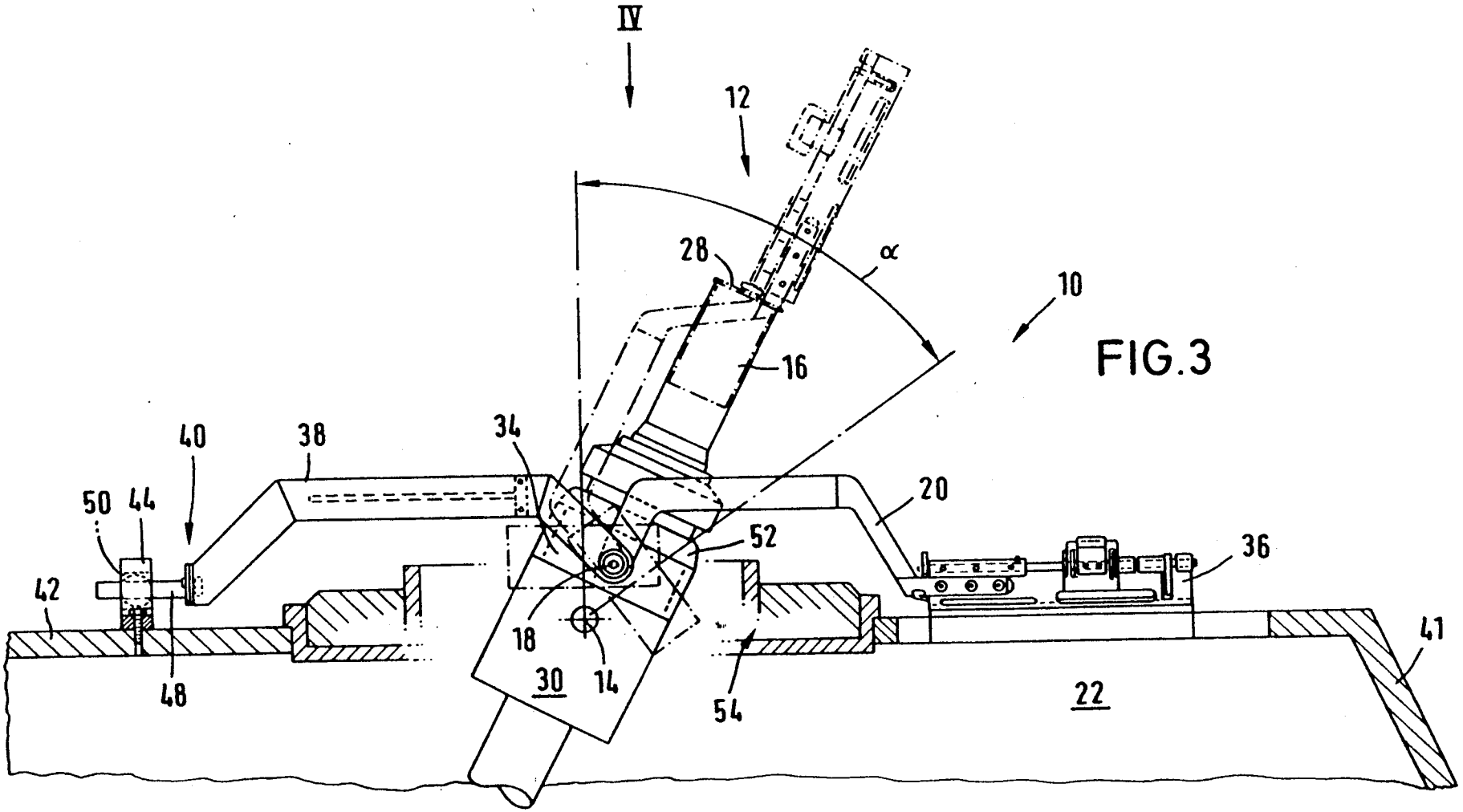
FIG. 3 is a sectional view taken along line III—III of FIG. 2.

Turning to FIGS. 3 and 4, the axially displaceable terminal shaft 48 of the positioner 38 is mounted inside a ball joint 50 of the bearing 44. The ball joint 50 has a pivotal range such that the positioner 38 may follow the elevational and transverse aiming motions of the weapon tube 16 and the tilt of the carrier vehicle 24 relative to the weapon tube 16. The positioner 38 is a stable guide fork, whose two fork arms 39 are connected by a stiffening plate 58 and are held in the respective articulations 19 mounted externally on the cardan ring 34. The shaft 48 which may be shifted in the axial direction 46 and pivoted about the center of the bearing 44 may be released for replacement at the outer end 40 of the guide fork 38 by a screw connection 60.

The cardan ring 34 is a cylindrical sleeve which may be immobilized in the axial direction of the weapon tube 16 by means of a sleeve nut 52 mounted on the cradle tube 30.

Figure 5:
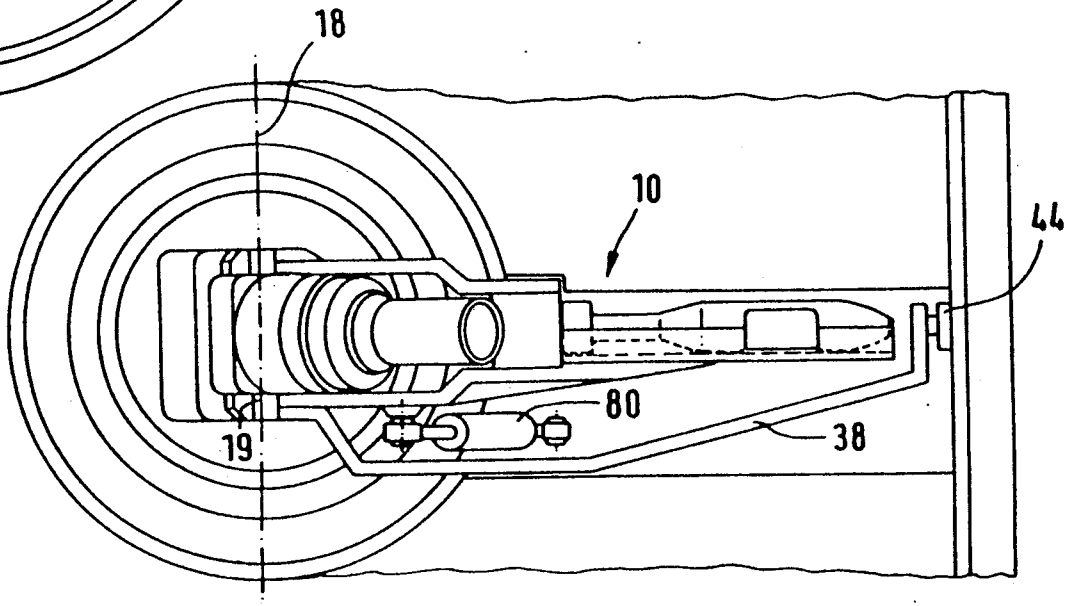
FIG. 5 is a top plan view similar to FIG. 4, illustrating a variant of the preferred embodiment.

A second preferred embodiment is illustrated in FIG. 5, according to which the positioner 38 is a single-arm component mounted between a single joint 19 affixed to the cardan ring 34 and the bearing 44 mounted stationarily on the vehicle. The bearing 44 of the positioner 38 may be mounted to the vehicle housing in a particularly space-saving manner next to the loading hatch 62. In this variant, the lateral excursions of the loading tray 36 performed during the aiming process of the weapon tube 16 may be reduced to a minimum in the zone of the loading hatch 62.

Referring now in particular to FIGS. 5 and 6, the loading manipulator 10 may be pivoted by a hydraulic piston-and-cylinder unit 80 about the axis 18 to a position in front of the muzzle 28 and, for performing the tray-charging process, it may be pivoted into the charging position 64 to a position adjacent the loading hatch 62.

FIG. 6 further shows the particular support of the cradle 30 in the levellable weapon platform 56 and the position of the cardan ring 34 situated above the weapon platform 56. The weapon platform 56 is designed such that maximum firing stresses can be taken up preferably in an elevational range $\alpha$ (FIG. 3) between 35° and 90° related to the carrier vehicle 24. The structure of the weapon platform 56 permits a direct arrangement of the cardan ring 34 in front of the cradle tube 30; as a result, the distance of the axis 18 to the trunnion axis 14 is small. By virtue of such a small distance between the two axes, in case of a maximum transverse aiming displacement of the weapon tube 16, the lateral excursions of the loading tray 36 in the charging zone of the loading hatch 62 will be acceptable.

Turning once again to FIG. 7, as noted earlier, the loading tray 36 connected with the loading manipulator 10 (not shown in FIG. 7) does not execute separate transverse and elevational motions in a horizontal plane 82 and in a vertical plane 84, but may be moved directly in a plane 68 defined by the momentary position of the weapon tube axis 17 and, for example, the longitudinal axis 43 of the vehicle.

It will be understood that the above description of the present invention is susceptible to various modifications, changes and adaptations, and the same are intended to be comprehended within the meaning and range of equivalents of the appended claims.

What is claimed is:

1. A front-loading mortar mounted on a base, comprising (a) a cradle tube;

(b) a weapon tube having a muzzle; said weapon tube being supported in said cradle tube;

(c) a trunnion axis about which the cradle tube including said weapon tube is pivotal for setting an elevation of the weapon tube;

(d) a cardan ring surrounding the cradle tube and being circumferentially displaceable about the weapon tube relative thereto;

(e) an additional pivot axis defined in said cardan ring at a location situated in front of the trunnion axis; and (f) a loading manipulator including (1) a loading rocker being articulated to said cardan ring for pivotal motion about said additional pivot axis;

(2) a loading tray secured to said loading rocker for carrying a round of ammunition from a fixed location at the base to a location in front of the muzzle as the loading rocker swings about said additional pivot axis;

(3) an eongate positioner being articulated to said cardan ring for pivotal motion about said additional pivot axis; said positioner having an end remote from said additional pivot axis; and (4) a bearing affixed to said base and receiving said end of said positioner for longitudinal sliding motion and pivotal motion therein.

2. A front-loading mortar as defined in claim 1, wherein the end of said positioner is a shaft having a sufficient length to be received at all times by said bearing as said additional pivot axis angularly moves relative to said trunnion axis upon elevational motions of said weapon tube about said trunnion axis.

3. A front-loading mortar as defined in claim 2, wherein said bearing comprises a ball joint longitudinally slidably receiving said shaft and having a rotary range such as to allow said positioner to follow elevation and transverse motions of said weapon tube and a tilt of said base relative to said weapon tube.

4. A front-loading mortar as defined in claim 3, wherein said positioner comprises a fork having two fork arms straddling said cardan ring and being articulated thereto at diametrically opposite locations thereof for pivotal motion about said additional pivot axis.

5. A front-loading mortar as defined in claim 4, further comprising means for releasably attaching said shaft to said fork.

6. A front-loading mortar as defined in claim 4, further comprising a trunnion defining said trunnion axis; a levelling means mounted on said base and receiving said trunnion for maintaining said trunnion axis in a horizontal orientation in case of a tilt of the base; and a stiffening member connecting said forks with one another.

7. A front-loading mortar as defined in claim 1, wherein said positioner comprises a one-armed component articulated to said cardan ring for pivotal motion about said additional pivot axis; said one-armed component extending to said bearing.

8. A front-loading mortar as defined in claim 1, further comprising a loading hatch provided in said base at said fixed location thereof; said bearing being mounted on said base adjacent said loading hatch.

9. A front-loading mortar as defined in claim 1, wherein said cardan ring is a cylindrical sleeve surrounding said cradle tube; further comprising immobilizing means for preventing axial motions of said cardan ring relative to said weapon tube.

10. A front-loading mortar as defined in claim 1, in combination with an armored vehicle having a housing; said base forming part of said housing.

* * * * *